US008741381B2

(12) United States Patent
Zhang et al.

(10) Patent No.: US 8,741,381 B2
(45) Date of Patent: Jun. 3, 2014

(54) METHOD FOR REMOVING A COATING AND A METHOD FOR REJUVENATING A COATED SUPERALLOY COMPONENT

(75) Inventors: Liming Zhang, Greer, SC (US); David Clayton Van Nest, III, Greenville, SC (US); Jere Allen Johnson, Greenville, SC (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 13/464,127

(22) Filed: May 4, 2012

(65) Prior Publication Data

US 2013/0295278 A1 Nov. 7, 2013

(51) Int. Cl.
*B05D 3/00* (2006.01)
*B05D 3/12* (2006.01)

(52) U.S. Cl.
USPC ..... 427/142; 427/327

(58) Field of Classification Search
USPC ..... 427/140, 142, 250, 327, 328, 307
See application file for complete search history.

(56) References Cited

U.S. PATENT DOCUMENTS

| | | | | |
|---|---|---|---|---|
| 3,833,414 | A | 9/1974 | Grisik et al. | |
| 5,976,265 | A * | 11/1999 | Sangeeta et al. | 134/3 |
| 6,465,040 | B2 * | 10/2002 | Gupta et al. | 427/142 |
| 6,844,086 | B2 | 1/2005 | Grossman et al. | |
| 6,875,292 | B2 | 4/2005 | Worthing, Jr. et al. | |
| 2004/0219290 | A1 * | 11/2004 | Nagaraj et al. | 427/140 |
| 2009/0188590 | A1 * | 7/2009 | Hu et al. | 148/528 |
| 2009/0305932 | A1 | 12/2009 | Powers et al. | |

FOREIGN PATENT DOCUMENTS

EP 1136593 A1 9/2001

* cited by examiner

*Primary Examiner* — Dah-Wei D Yuan
*Assistant Examiner* — Nga Leung V Law
(74) *Attorney, Agent, or Firm* — McNees Wallace & Nurick LLC

(57) ABSTRACT

A method for controlled removal of a portion of a diffusion coating from a coated superalloy component and a method for rejuvenating a coated superalloy component are provided. The methods include providing the component having an oxide layer, an additive layer between the oxide layer and a diffusion zone, the diffusion zone being between the additive layer and a superalloy substrate of the superalloy component. The methods include selectively removing the oxide layer and a portion of the additive layer by grit blasting, wherein removing creates an exposed portion. Rejuvenating includes applying an aluminide coating to the exposed portion and heat treating at a preselected elevated temperature to form a rejuvenated protective aluminide coating on the superalloy component.

18 Claims, 6 Drawing Sheets

METHOD FOR REMOVING A COATING AND A METHOD FOR REJUVENATING A COATED SUPERALLOY COMPONENT

FIELD OF THE INVENTION

The present invention relates generally to a method of coating superalloy components. More specifically, to a method for controlled removal of a portion of a diffusion coating from a coated superalloy component and method for rejuvenating a coated superalloy component.

BACKGROUND OF THE INVENTION

When turbines are used on aircraft or for power generation, they are typically run at a temperature as high as possible, for maximum operating efficiency. Since high temperatures can damage the alloys used for the components, a variety of approaches have been used to raise the operating temperature of the metal components.

Nickel-base superalloys are used in many of the highest-temperature materials applications in gas turbine engines. For example, nickel-base superalloys are used to fabricate the components such as high-pressure and low-pressure gas turbine blades, vanes or nozzles, stators and shrouds. These components are subjected to extreme conditions of both stress and environmental conditions. The compositions of the nickel-base superalloys are engineered to carry the stresses imposed upon the components. Protective coatings are typically applied to the components to protect them against environmental attack by the hot, corrosive combustion gases.

A widely used protective coating is an aluminum-containing coating termed a diffusion aluminide coating. Diffusion processes generally entail reacting the surface of a component with an aluminum-containing gas composition to form two distinct zones, the outermost of which is an additive layer containing an environmentally-resistant intermetallic represented by MAl, where M is iron, nickel or cobalt, depending on the substrate material. The MAl intermetallic is the result of deposited aluminum and an outward diffusion of iron, nickel and/or cobalt from the substrate. During high temperature exposure in air, the MAl intermetallic forms a protective aluminum oxide (alumina) scale or oxide layer that inhibits oxidation of the diffusion coating and the underlying substrate. The chemistry of the additive layer can be modified by the presence in the aluminum-containing composition of additional elements, such as platinum, chromium, silicon, rhodium, hafnium, yttrium and zirconium. Diffusion aluminide coatings containing platinum, referred to as platinum aluminide coatings, are particularly widely used on gas turbine engine components.

The second zone of a diffusion aluminide coating is formed in the surface region of the component beneath the additive layer. The diffusion zone contains various intermetallic and metastable phases that form during the coating reaction as a result of diffusional gradients and changes in elemental solubility in the local region of the substrate. The intermetallics within the diffusion zone are the products of all alloying elements of the substrate and diffusion coating.

Though significant advances have been made with environmental coating materials and processes for forming such coatings, there is the inevitable requirement to repair or replace these coatings under certain circumstances. For example, removal may be necessitated by erosion or thermal degradation of the diffusion coating, refurbishment of the component on which the coating is formed, or an in-process repair of the diffusion coating or a thermal barrier coating (if present) adhered to the component by the diffusion coating. The current state-of-the-art repair process is to completely remove a diffusion aluminide coating by treatment with an acidic solution capable of interacting with and removing both the additive and diffusion layers.

Removal of the entire aluminide coating, which includes the diffusion zone, results in the removal of a portion of the substrate surface. For components, such as gas turbine engine blade and vane airfoils, removing the diffusion zone may cause alloy depletion of the substrate surface and, for air-cooled components, excessively thinned walls and drastically altered airflow characteristics to the extent that the component must be scrapped.

Most methods currently used to remove diffusion coatings to expose the surface of the superalloy component or to completely remove the additive layer include using an acid strip, multiple grit blastings, and subsequent heat tinting processes to verify that the aluminide is completely removed from the surface of the superalloy component. The acid strip uses harsh chemicals such as phosphoric, nitric, or hydrochloride acids which require special facilities to remove the additive layer and the diffusion layer.

Therefore, a method for controlled removal of at least a portion of a thickness of an additive coating from a coated superalloy component and a method for rejuvenating a coated superalloy component that do not suffer from the above drawbacks are desirable in the art.

SUMMARY OF THE INVENTION

According to an exemplary embodiment of the present disclosure, a method for controlled removal of at least a portion of a thickness of a diffusion coating from a coated superalloy component is provided. The method includes providing the coated superalloy component comprising an oxide layer, an additive layer between the oxide layer and a diffusion zone, the diffusion zone being between the additive layer and a superalloy substrate of the superalloy component. The method includes selectively removing the oxide layer and a portion of the additive layer by grit blasting.

According to another exemplary embodiment of the present disclosure, a method for rejuvenating a coated superalloy component, the coated superalloy component having undergone service at an elevated temperature. The method includes providing the coated superalloy component comprising an oxide layer, an additive layer between the oxide layer and a diffusion zone, the diffusion zone being between the additive layer and a superalloy substrate of the superalloy component. The method includes selectively removing the oxide layer and a portion of the additive layer by grit blasting, wherein removing creates an exposed portion. The method includes applying an aluminide coating to the exposed portion. The method includes a diffusion heat treating at a preselected elevated temperature to form a rejuvenated protective aluminide coating on superalloy component.

Other features and advantages of the present invention will be apparent from the following more detailed description of the preferred embodiment, taken in conjunction with the accompanying drawings which illustrate, by way of example, the principles of the invention.

BRIEF DESCRIPTION OF THE DRAWINGS

Wherever possible, the same reference numbers will be used throughout the drawings to represent the same parts.

DETAILED DESCRIPTION OF THE INVENTION

Provided is a method for controlled removal of at least a portion of a thickness of an additive coating from a superalloy component and a method for rejuvenating a coated superalloy component having undergone service at an elevated temperature. The present disclosure is generally applicable to components that are protected from a thermally and chemically hostile environment by a diffusion aluminide coating. Notable examples of such components include the high and low pressure turbine nozzles and blades, shrouds, combustor liners and augmentor hardware of gas turbine engines. While the advantages of this disclosure are particularly applicable to gas turbine engine components, the teachings of this disclosure are generally applicable to any component on which a diffusion aluminide coating may be used to protect the component from its environment.

One advantage of an embodiment of the present disclosure includes reduced time and labor for recoating or rejuvenating a superalloy component after service in a turbine. Another advantage of an embodiment of the present disclosure is reduced cost in recoating and rejuvenating components after service in a turbine. Yet another advantage of an embodiment of the present disclosure is that the rejuvenated coating on the superalloy component has substantially the same chemistry as an originally manufactured superalloy component having a protective aluminide coating prior to any service in a turbine. Another advantage of an embodiment of the present disclosure is that the coating microstructure and chemistry of the rejuvenated coating meets engineering requirements. Yet another advantage of an embodiment of the present disclosure is that the method and rejuvenated coating maintain dimensional and airflow requirements and improve repair hardware yields. Another advantage of an embodiment of the present disclosure is that the method consumes less wall thickness than a full-stripping repair using acids.

Figure 1:
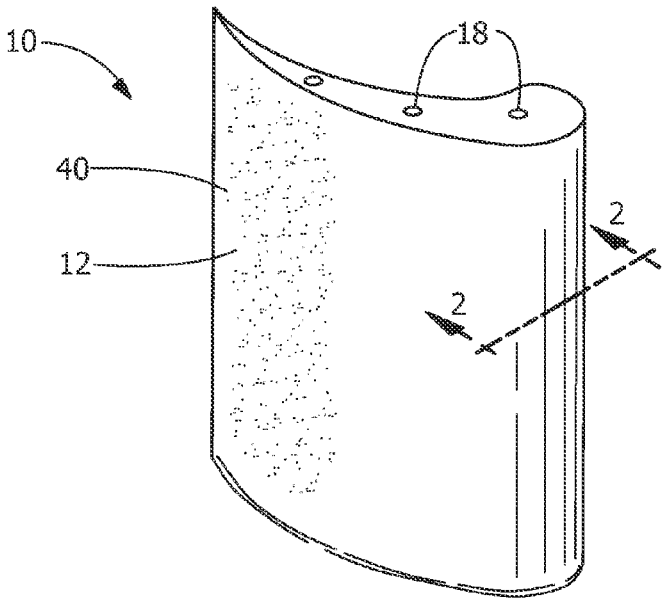
FIG. 1 is a perspective view of a component having undergone service at an elevated temperature of the present disclosure.

FIG. 1 depicts a coated superalloy component 10 after service in a turbine that can be used with the method of the present disclosure, and in this illustration is an airfoil 12. As shown in the figures, cooling holes 18 are present in airfoil 12 through which bleed air is forced to transfer heat from airfoil 12. Particularly suitable materials for component 10 include nickel based superalloys, though it is foreseeable that other materials could be used. Although depicted as airfoil 12, component 10 includes, but is not limited to, high-pressure and low-pressure gas turbine blades, vanes or nozzles, stators and shrouds. As shown in FIG. 1, after service life, which is about 12,000 to about 24,000 hours at temperatures exceeding about 800° C. (about 1500° F.), component 10 has a visible oxide layer 40.

Figure 2:
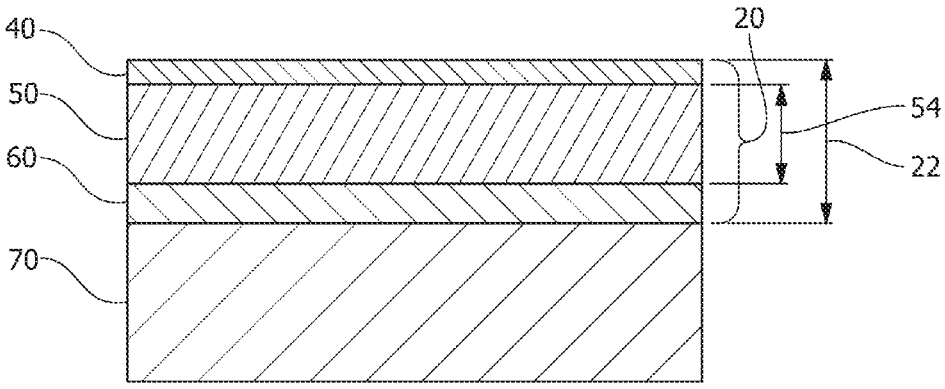
FIG. 2 is a schematic sectional view taken in direction 2-2 of FIG. 1 of the component having under gone service of the present disclosure.

FIG. 2 is a cross-sectional view of the coated superalloy component 10 of FIG. 1 after about 12,000 to about 24,000 hours of service in a turbine. Coated superalloy component 10 includes a diffusion coating 20 on superalloy substrate 70. A typical thickness 22 of diffusion coating 20 is about 38.1 microns (about 1.5 milli-inches or mils) to about 101.6 microns (about 4.0 mils), or alternatively about 45 microns to about 90 microns, or alternatively about 50 microns to about 80 microns. Thickness 22 of diffusion coating 20 includes thickness of oxide layer 40, thickness of additive layer 50 and thickness of diffusion zone 60. Oxide layer 40 is generally very thin and is about 5 microns to about 10 microns, or alternatively about 6 microns to about 9 microns, or alternatively about 7 microns to about 8 microns. Additive layer 50 is between oxide layer 40 and diffusion zone 60. Additive layer 50 typically has a thickness 54 of about 12.7 microns (0.5 mils) to about 63.5 microns (2.5 mils), or alternatively about 17.8 microns (0.7 mils) to about 50.8 microns (2.0 mils), or alternatively about 22.9 microns (0.9 mils) to about 43.1 microns (1.7 mils). Additive layer 50 contains an environmentally resistant intermetallic phase MAl, where M is iron, nickel or cobalt, depending on the substrate material (mainly β(NiAl) if the substrate is nickel-based). Diffusion zone 60 is between additive layer 50 and superalloy substrate 70 of the coated superalloy component 10. Thickness of diffusion zone 60 varies and is generally about 7.62 microns (0.30 mils) to 17.78 microns (0.70 mils) thick, or alternatively about 8.00 microns to about 16.00 microns, or alternatively about 9.00 microns to about 15.00 microns. Superalloy substrate 70 generally includes nickel-based superalloys but other superalloys are possible.

Figure 3:
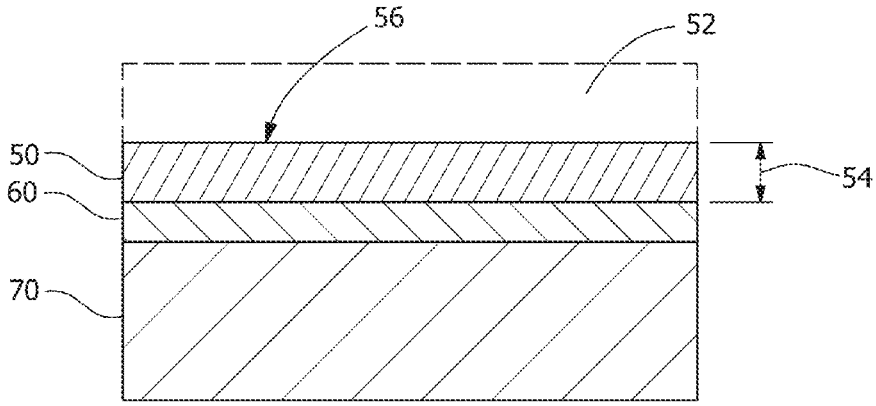
FIG. 3 is a schematic of the component in FIG. 2 after the oxide layer and a portion of the additive layer have been removed of the present disclosure.

As shown in FIG. 3, oxide layer 40 and a portion 52 of additive layer 50 of diffusion coating 20 are selectively removed from coated superalloy component 10 by grit blasting. Removing portion 52 of additive layer 50 creates exposed portion 56 of additive layer 50. Portion 52 of additive layer 50 removed is about 25% to about 100%, or alternatively about 25% to about 80%, or alternatively about 30% to about 50% of thickness 54 of additive layer 50. A dry grit blasting method is used to remove portion 52 of additive layer 50. The pressure used while grit blasting is about 30 psi to about 60 psi, or alternatively about 35 psi to about 55 psi, or alternatively about 38 psi to about 50 psi. The media used for grit blasting is alumina ($Al_2O_3$), silicon carbide (SiC), and combinations thereof, or other media that selectively removes only additive layer 50 from coated superalloy component 10. The size of the grit media is about 177 microns (80 grit) to about 63 microns (220 grit), or alternatively about 149 microns (100 grit) to about 88 microns (170 grit), or alternatively about 149 microns (100 grit) to about 105 microns (140 grit). The combination of the pressure, grit media, and grit size allows for selective removal of portion 52 of additive layer 50. The grit blasting used in the current method allows for a visual inspection of removal of portion 52 of additive layer 50. Grit blasting of the current method removes little or none of the diffusion zone 60 and does not remove any part of underlying superalloy substrate 70.

Figure 4:
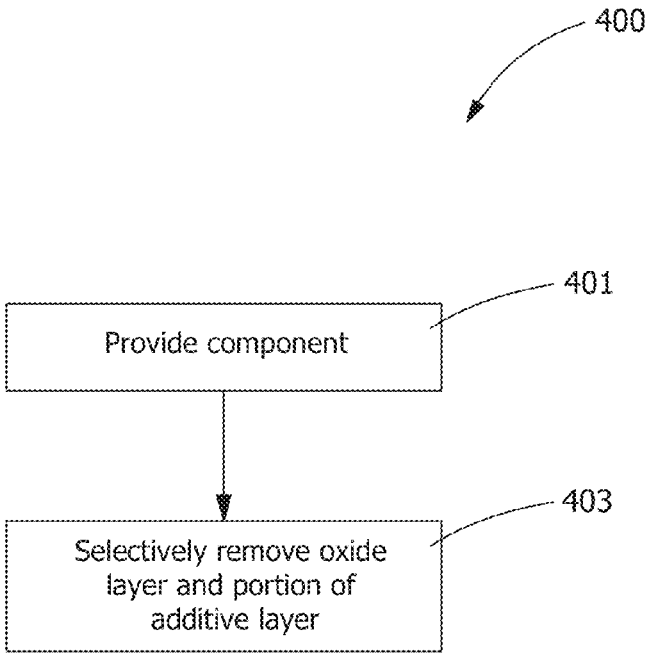
FIG. 4 is a flow chart of an exemplary method of removing a portion of a thickness of an additive coating from a coated superalloy component of the present disclosure.

FIG. 4 is a flow chart describing a method 400 for controlled removal of at least portion of thickness 22 of diffusion coating 20 from a coated superalloy component 10 (see FIG. 3). Method 400 includes providing coated superalloy component 10 having diffusion coating 20 after service in a turbine, step 401 (see FIG. 1). Diffusion coating 20 includes oxide layer 40, additive layer 50 and diffusion zone 60 on superalloy substrate 70 of coated superalloy component 10 (see FIG. 2). Method 400 includes selectively removing oxide layer 40 and portion 52 of additive layer 50 of diffusion coating 20 by grit blasting. Dry grit blasting is conducted at about 30 psi to about 60 psi with the media being alumina (Al2O3) or silicon carbide (SiC) and the size of the media is about 177 microns (80 grit) to about 63 microns (220 grit). Portion 52 of additive layer 50 removed by grit blasting is about 25% to about 100% of thickness 54 of additive layer 50 (see FIG. 3). Grit blasting of the current method removes little or none of the diffusion zone 60 and does not remove any part of underlying superalloy substrate 70. Prior to the step of selectively removing, step 403, coated superalloy component 10 is degreased or hot water washed to remove any residue oil and grease from surface of coated superalloy component 10. An additional step after the step of selectively removing, step 403, is to remove any remaining grit or debris from the grit blasting by using air blasting over exposed portion 56 of component 10. Another additional step after the step of selectively removing, step 403, is repairing coated superalloy component 10. Repairing coated superalloy component 10 includes, but is not limited to, spot welding, MIG welding, TIG welding, and brazing. Method 400 applies to coated superalloy components 10 needing the aluminide coating removed. Coated superalloy components 10 include, for example, but not limited to, blades, vanes, nozzles, stators, shrouds, buckets, and combinations thereof.

Figure 5:
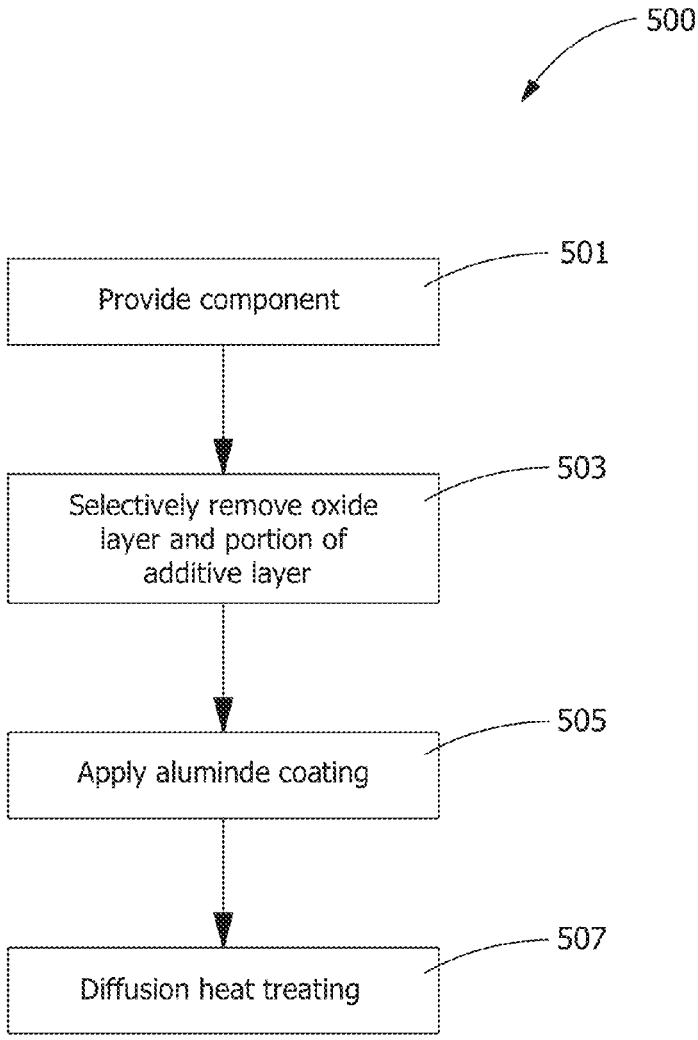
FIG. 5 is a flow chart of a method of rejuvenating a coated superalloy component having undergone service at an elevated temperature of the present disclosure.

FIG. 5 is a flow chart describing method 500 for rejuvenating coated superalloy component 10 after coated superalloy component 10 has undergone service at an elevated temperature of approximately 800° C. or greater. As used herein rejuvenated coating means forming a new coating including the remaining portions of the existing coating and new applied vapor phase deposition or a gel aluminide coating, where the new rejuvenated coating has almost the same chemistry as the OEM coating prior to service. Method includes providing coated superalloy component 10 having diffusion coating 20 after service in a turbine, step 401 (see FIG. 1). Diffusion coating 20 includes oxide layer 40, additive layer 50 and diffusion zone 60 on superalloy substrate 70 of coated superalloy component 10 (see FIG. 2). Method 500 includes selectively removing oxide layer 40 and portion 52 of additive layer 50 by grit blasting, wherein removing creates an exposed portion 56, step 503 (see FIG. 2). Dry grit blasting is conducted at about 30 psi to about 60 psi with the media being alumina (Al2O3) or silicon carbide and the size of the media being about 177 microns (80 grit) to about 63 microns (220 grit). Portion 52 of additive layer 50 removed by grit blasting is about 25% to about 100% of thickness 54 of additive layer 50 (see FIG. 3). Grit blasting of the current method removes little or none of the diffusion zone 60 and does not remove any part of underlying superalloy substrate 70 (see FIG. 3). Visual inspection can be used to determine that desired portion 52 of additive layer 50 has been removed. Diffusion zone 60 is generally a shinier gray metal than the additive layer 50, which has more of a matte or dull gray metal finish, and can been seen without the use of special tools. Method 500 includes applying an aluminide coating 66 to exposed portion 56, step 505 (see FIG. 7). Applying aluminide coating, step 505 is done by any suitable process such as vapor phase deposition or a gel aluminide coating process. Method 500 includes heat treating at a preselected elevated temperature to form a rejuvenated protective aluminide coating 90 on superalloy component 10, step 507. Heat treating includes using a furnace to bring up temperature of superalloy component 10 to open up metal of substrate 70 to allow the material from the diffusion zone 60 to flow into substrate 70 and bond with the base material to form rejuvenated protective aluminide coating 90. Rejuvenated protective aluminide coating 90 of method 500 has a coating microstructure and a coating chemistry matching an original coating 82 of a new superalloy component 80 prior to service in a turbine (see FIGS. 6, 8 and 9).

Prior to the step of selectively removing, step 503, coated superalloy component 10 is degreased or hot water washed to remove any residue oil and grease from surface of coated superalloy component 10. An additional optional step, after the step of degreasing is cleaning the surface of the coated superalloy component. An additional step after the step of selectively removing, step 503, is removing any remaining grit or debris from the grit blasting by using air blasting over exposed portion 56 of component 10. Another additional step, after the step of selectively removing, step 503, and prior to the step of applying aluminide coating, step 505, is repairing the coated superalloy component. Method 500 applies to coated superalloy components 10 needing aluminide coating removal, which include, for example, but not limited to, blades, vanes, nozzles, stators, shrouds, buckets, and combinations thereof.

Figure 6:
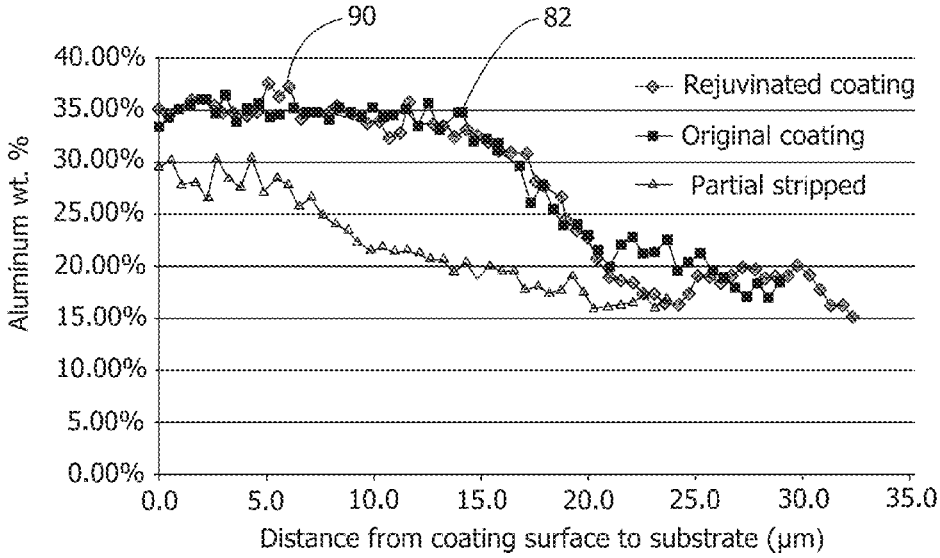
FIG. 6 is a graph comparing the chemistry of the rejuvenated coating of the present disclosure to an originally coated component prior to service.

As shown in FIG. 6, a chemical comparison of the rejuvenated protective aluminide coating 90 of re-coated superalloy component 10 (see FIG. 8), original coating 82 of new superalloy component 80 prior to any service in a turbine (see FIG. 9), and exposed portion 56 of coated superalloy component 10 (see FIG. 7) is provided. To prepare the samples for analysis each sample was coated with a nickel plating 66 to protect the various coatings from damage during cutting the components. To analyze chemical compositions of the different samples a Scanning Electron Microscope (SEM) equipped with and Energy Dispersive Spectrometer (EDS) is used (see FIGS. 10-12). As shown by the graph in FIG. 6, the chemical composition, namely the aluminum content of the rejuvenated coating 90 (see FIG. 8), practically tracks the aluminum content of the original coating 82 of new superalloy component 80 (see FIG. 9 and photomicrograph, FIG. 12). The graph in FIG. 6 provides support for rejuvenated protective aluminide coating 90 having a coating microstructure and a coating chemistry substantially matching an original coating 82 of a new superalloy component 80 prior to service in a turbine (see FIGS. 6, 8 and 9).

Figures 10, 11, 12:
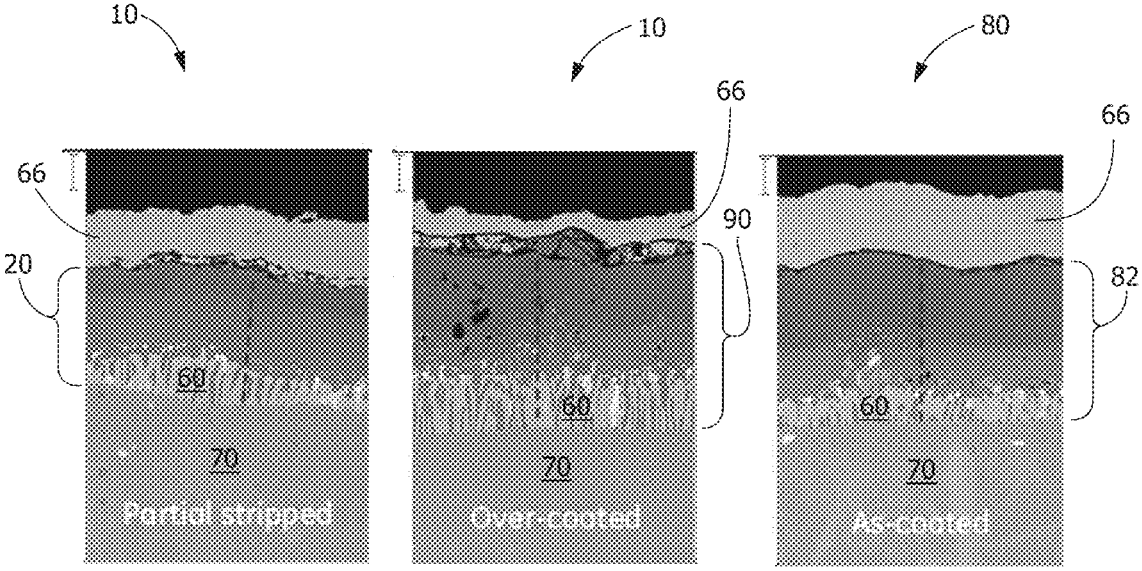
FIG. 10 is a photomicrograph including the layers of FIG. 7 and a nickel plating for cutting according to the present disclosure.
FIG. 11 is a photomicrograph of the layers of FIG. 8 and a nickel platting for cutting according to the present disclosure.
FIG. 12 is a photomicrograph of the layers of FIG. 9 and a nickel platting for cutting according to the present disclosure.
Figure 7:
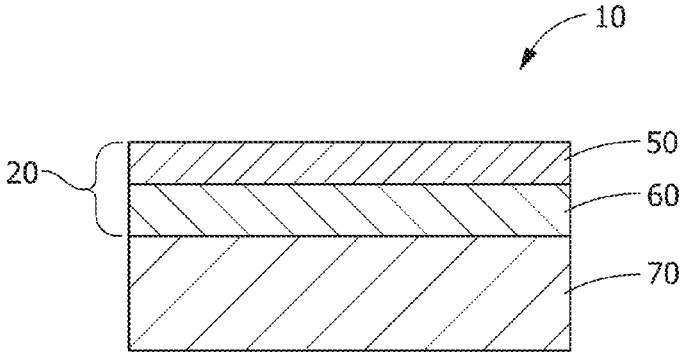
FIG. 7 is a schematic of the layers on the surface of component having a portion of the additive layer removed according to the present disclosure

FIG. 7 is a schematic of the layers on the surface of a coated superalloy component 10 having undergone service in a turbine. As shown in FIG. 7, oxide layer 40 and portion of additive layer have been removed from coated superalloy component 10. FIG. 10 is a photomicrograph using SEM depicting the layers of coated superalloy component 10. As evidenced by the elemental analysis (see FIG. 6), the aluminum rich layer has been removed.

Figure 8:
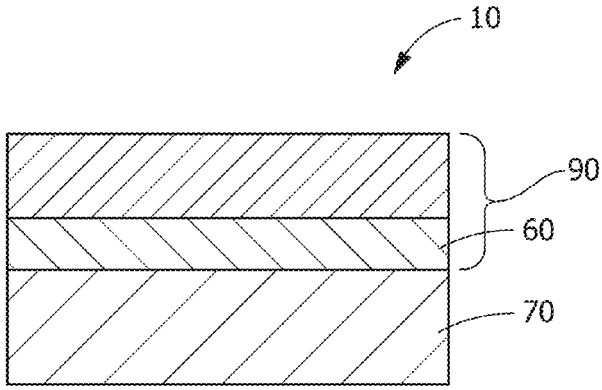
FIG. 8 is a schematic of layers on the surface a component with a rejuvenated coating according to a method of the present disclosure.

FIG. 8 is a schematic of layers on the surface of component 10 with rejuvenated coating 90. As shown in FIG. 8, rejuvenated coating 90 is includes diffusion zone 60 adjacent substrate 70. FIG. 11 is a photomicrograph using SEM depicting the layers of component 10 having rejuvenated coated 90. As evidenced by the elemental analysis (see FIG. 6), the aluminum content in the rejuvenated coating 90 is approximately the same as that of original coating 82 or first time coating of the new superalloy component 80.

Figure 9:
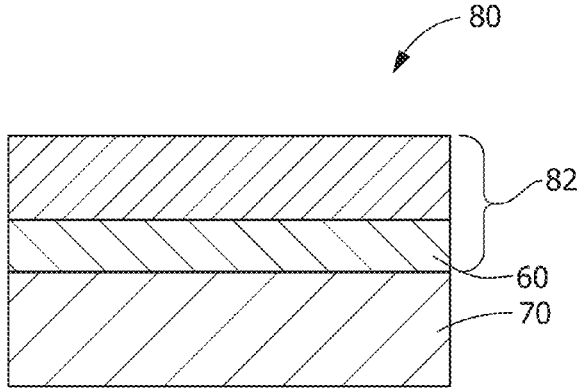
FIG. 9 is a schematic of the layers on the surface of a new component prior to any service at an elevated temperature.

FIG. 9 is a schematic of layers on the surface of new superalloy component 80 having original coating 82 or first time coating prior to service.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A method for controlled removal of at least a portion of a thickness of a diffusion coating from a coated superalloy component, the controlled removal method of at least a portion of a thickness of a diffusion coating consisting of the steps of:

providing the coated superalloy component having the diffusion coating comprising an oxide layer, an additive layer between the oxide layer and a diffusion zone, the diffusion zone being between the additive layer and a superalloy substrate of the superalloy component;

selectively removing the oxide layer and a portion of the additive layer by grit blasting, wherein the portion of the additive layer removed is about 25% to about 80% of the thickness of the additive layer; and optionally, after the step of selectively removing, air blasting.

2. The method of claim 1, wherein the grit blasting uses a pressure of about 30 psi to about 50 psi.

3. The method of claim 1, wherein the grit blasting is a dry grit blasting.

4. The method of claim 1, wherein the grit blasting uses a grit media having about 177 microns (80 grit) to about 63 microns (220 grit).

5. The method of claim 1, the grit blasting uses a grit media comprising alumina ($Al_2O_3$), silicon carbide (SiC), and combinations thereof.

6. The method of claim 1, wherein the superalloy component comprises blades, vanes, nozzles, stators, shrouds, buckets, and combinations thereof.

7. A method for rejuvenating a coated superalloy component having a surface, the coated superalloy component having undergone service at an elevated temperature, the method consisting of:

providing the coated superalloy component having a diffusion coating comprising an oxide layer, an additive layer between the oxide layer and a diffusion zone, the diffusion zone being between the additive layer and a superalloy substrate of the superalloy component;

optionally degreasing the surface of the coated superalloy component;

optionally cleaning the surface of the coated superalloy component;

selectively removing the oxide layer and a portion of the additive layer by grit blasting, wherein the portion of the additive layer removed is about 25% to about 80% of the thickness of the additive layer and wherein removing creates an exposed portion;

applying an aluminide coating to the exposed portion; and diffusion heat treating at a preselected elevated temperature to form a rejuvenated protective aluminide coating on the superalloy component.

8. A method for rejuvenating a coated superalloy component having a surface, the coated superalloy component having undergone service at an elevated temperature, the method consisting of:

providing the coated superalloy component having a diffusion coating comprising an oxide layer, an additive layer between the oxide layer and a diffusion zone, the diffusion zone being between the additive layer and a superalloy substrate of the superalloy component;

optionally degreasing the surface of the coated superalloy component;

optionally cleaning the surface of the coated superalloy component;

selectively removing the oxide layer and a portion of the additive layer by grit blasting, wherein the portion of the additive layer removed is about 25% to about 80% of the thickness of the additive layer and wherein removing creates an exposed portion;

repairing the coated superalloy component;

applying an aluminide coating to the exposed portion; and diffusion heat treating at a preselected elevated temperature to form a rejuvenated protective aluminide coating on the superalloy component.

9. The method of claim 7, wherein the aluminide coat is applied by vapor phase deposition or a gel process.

10. The method of claim 7, wherein the grit blasting uses a pressure of about 30 psi to about 60 psi.

11. The method of claim 7, wherein the grit blasting is a dry grit blasting.

12. The method of claim 7, wherein the rejuvenated protective aluminide coating has a coating microstructure and a coating chemistry substantially matching a first time coating of a substrate prior to service in a turbine.

13. The method of claim 7, wherein the superalloy component comprises blades, vanes, nozzles, stators, shrouds, buckets, and combinations thereof.

14. The method of claim 8, wherein the aluminide coat is applied by vapor phase deposition or a gel process.

15. The method of claim 8, wherein the grit blasting uses a pressure of about 30 psi to about 60 psi.

16. The method of claim 8, wherein the grit blasting is a dry grit blasting.

17. The method of claim 8, wherein the rejuvenated protective aluminide coating has a coating microstructure and a coating chemistry substantially matching a first time coating of a substrate prior to service in a turbine.

18. The method of claim 8, wherein the superalloy component comprises blades, vanes, nozzles, stators, shrouds, buckets, and combinations thereof.

* * * * *